US007486237B2

(12) United States Patent
Huang et al.

(10) Patent No.: US 7,486,237 B2
(45) Date of Patent: Feb. 3, 2009

(54) MINIATURIZED PLANAR ANTENNA OF DIGITAL TELEVISION

(75) Inventors: Jiunn-Ming Huang, Taipei Hsien (TW); Chih-Lung Chen, Taipei Hsien (TW); Kuan-Hsueh Tseng, Taipei Hsien (TW)

(73) Assignee: Wistron Neweb Corporation, Hsichi, Taipei Hsien (TW)

( * ) Notice: Subject to any disclaimer, the term of this patent is extended or adjusted under 35 U.S.C. 154(b) by 0 days.

(21) Appl. No.: 11/798,051

(22) Filed: May 9, 2007

(65) Prior Publication Data

US 2008/0074326 A1 Mar. 27, 2008

(30) Foreign Application Priority Data

Jun. 23, 2006 (TW) ..... 95122660 A

(51) Int. Cl.
*H01Q 1/38* (2006.01)

(52) U.S. Cl. ..... 343/700 MS; 343/702; 343/895

(58) Field of Classification Search ..... 343/700 MS, 343/702, 895, 846, 829
See application file for complete search history.

(56) References Cited

U.S. PATENT DOCUMENTS 6,417,816 B2 * 7/2002 Sadler et al. ..... 343/795
6,894,646 B2 * 5/2005 Washiro et al. ..... 343/700 MS
6,967,618 B2 * 11/2005 Ojantakanen et al. . 343/700 MS
7,119,743 B2 * 10/2006 Iguchi et al. ..... 343/700 MS

* cited by examiner

*Primary Examiner*—Tho G Phan

(57) ABSTRACT

A miniaturized planar antenna of digital television comprises an insulation plate a metal radiator combined with a first surface thereof, a metal grounding element connected to a second surface thereof and a metal parasitic element. The metal radiator has a meander line portion and the metal parasitic element also has a meander line portion and is corresponding to a position of the metal radiator; the transmission efficiency of digital television signals can be elevated by broadening an electromagnetic signal receiving bandwidth of the antenna by means of the metal parasitic element.

19 Claims, 8 Drawing Sheets

MINIATURIZED PLANAR ANTENNA OF DIGITAL TELEVISION

BACKGROUND OF THE INVENTION

1. Field of the Invention

The present invention relates to an antenna of a portable electronic device such as cellular phone, notebook computer or personal digital assistant, and more particularly to an antenna used for receiving digital television signals.

2. Description of Related Art

There are many antennas used for receiving digital television signals such as the ones disclosed in U.S. Pat. No. 6,819,297, U.S. Pat. No. 6,639,555, U.S. Pat. No. 6,259,416, Taiwan Patent No. I255,589, I240,451 and M285,154, and Taiwan Patent Publication No. 521,455.

Among these, Taiwan Patent Publication No. 521,455 discloses a miniaturized planar antenna of digital television, it comprises a base plate whose upper and lower surfaces respectively are a strip line formed by copper foil printing and a plurality of parallel rampart-line-typed antennas formed by copper foil printing and respectively disposed on the upper and the lower surfaces of the base plate, intersected and connected to the strip line and distributed in two symmetrical quadrants, in which each quadrant has at least three sets of antennas.

Accompanying the development of the combination of a digital television and a portable electronic product such as a cellular telephone, notebook computer or PDA, miniaturizing a broadband antenna of the digital television is an unavoidable tendency.

Please refer to FIG. 1. For miniaturizing an antenna 10, it is general to combine a first surface of a circuit board 11 with a metal radiator 12; the metal radiator 12 is a meander line so as to attain the requirement of the size miniaturization. Furthermore, a grounding terminal 13 is combined to a second surface of the circuit board 11; the grounding terminal 13 generally is a metal film. One end of the radiator 12 is connected to a micro-strip line 14 and one end of the micro-strip line 14 is used as a feeding point 141.

The antenna 10 mentioned above can attain to the requirement of the miniaturization, but the bandwidth thereof is rather narrow such that the electromagnetic signal transmission efficiency is rather bad.

SUMMARY OF THE INVENTION

For improving the signal transmission efficiency of a miniaturized antenna combined to a portable electronic device such as a cellular telephone, notebook computer or PDA and used for receiving digital television signals, the present invention is proposed.

The main object of the present invention is to provide a miniaturized planar antenna of digital television, capable of elevating the electromagnetic signal transmission efficiency.

Another object of the present invention is to provide a miniaturized planar antenna of digital television, capable of broadening a bandwidth of the electromagnetic signal transmission of an electronic device.

For attaining to the objects of the present invention mentioned above, a miniaturized planar antenna of digital television comprises an insulation plate, a metal radiator used for allowing the antenna to receive electromagnetic signals, combined to a first surface of the insulation board and including a meander line, a metal grounding element used for a grounding terminal of the antenna and combined to a second surface of the insulation plate and a metal parasitic element, combined to a second surface of the insulation plate, corresponding to a position of the metal radiator and including a meander line provided with a first end thereof electrically connected to the metal grounding element.

whereby, a bandwidth that the antenna receives electromagnetic signals can be broadened by means of the metal parasitic element so as to elevate the transmission efficiency of the electromagnetic signals.

BRIEF DESCRIPTION OF THE DRAWINGS

The present invention can be more fully under-stood by reference to the following description and accompanying drawings, in which.

DETAILED DESCRIPTION OF THE PREFERRED EMBODIMENTS

Figure 1:
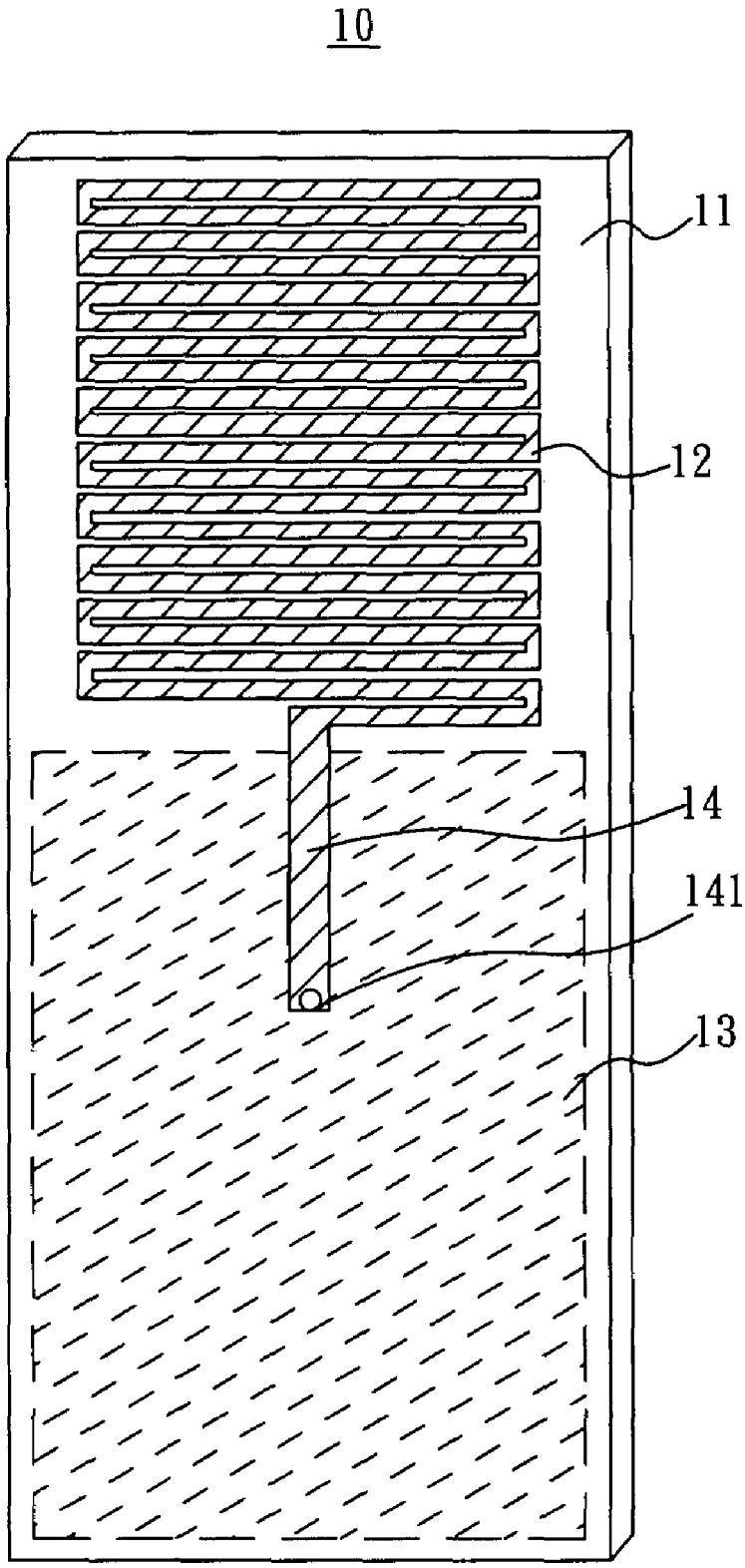
FIG.1 (PRIOR ART)
FIG. 1 is a schematic view of a conventional miniaturized planar antenna of a digital television.
Figure 2:
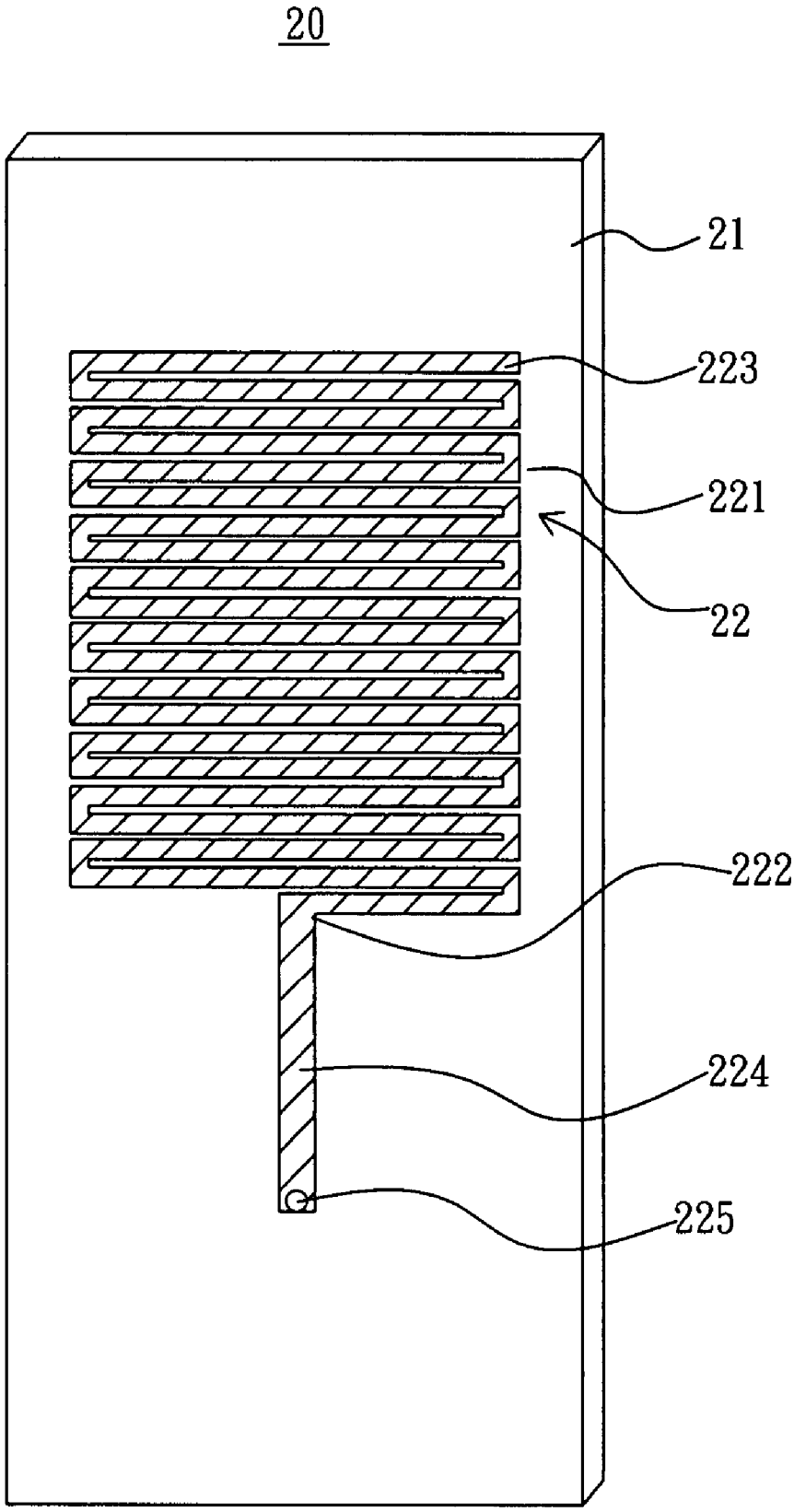
FIG. 2 is a schematic view of an antenna of a first embodiment according to the present invention.
Figure 3A:
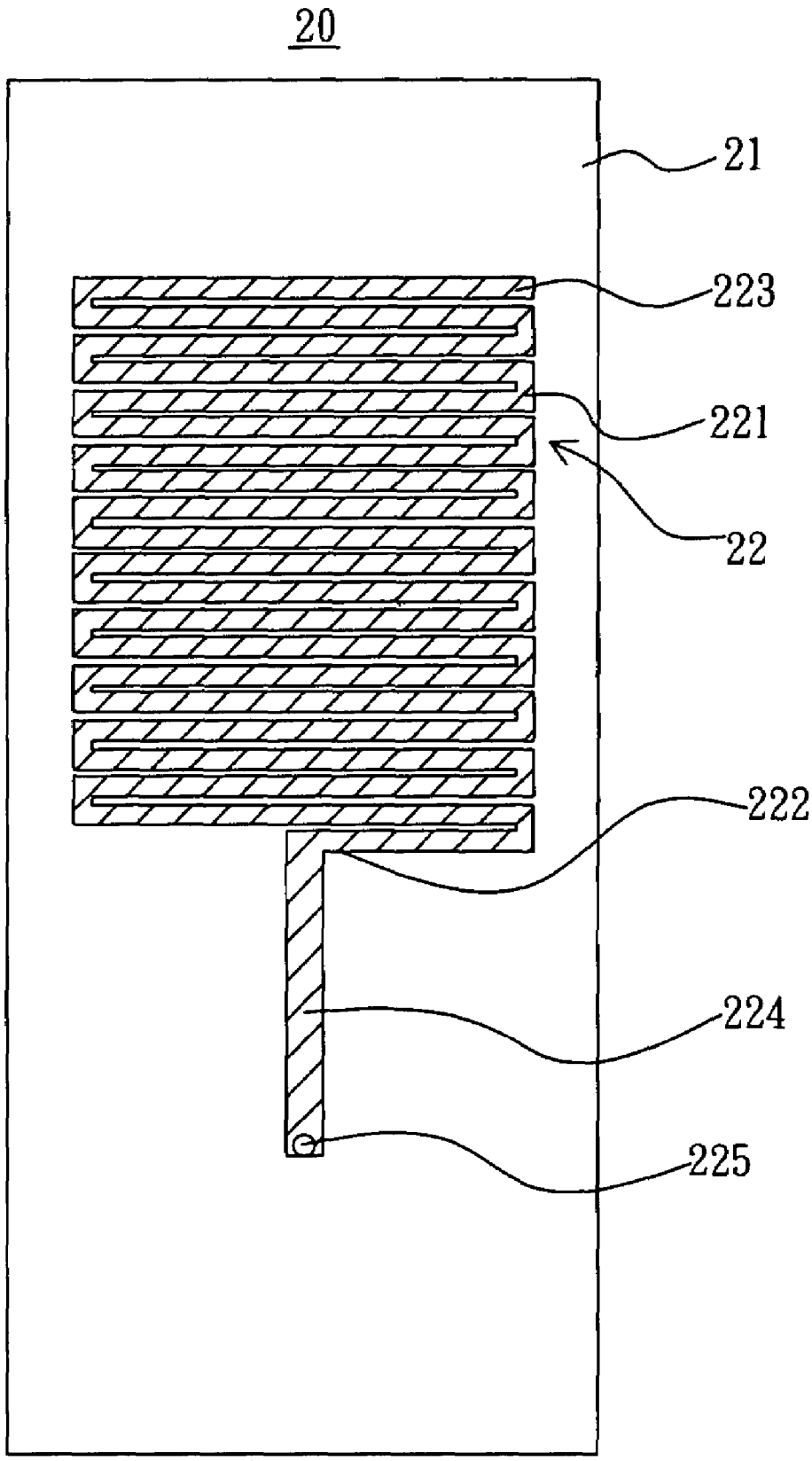
FIG. 3A is a schematic view, showing a first surface of an antenna of a first embodiment according to the present invention.
Figure 3B:
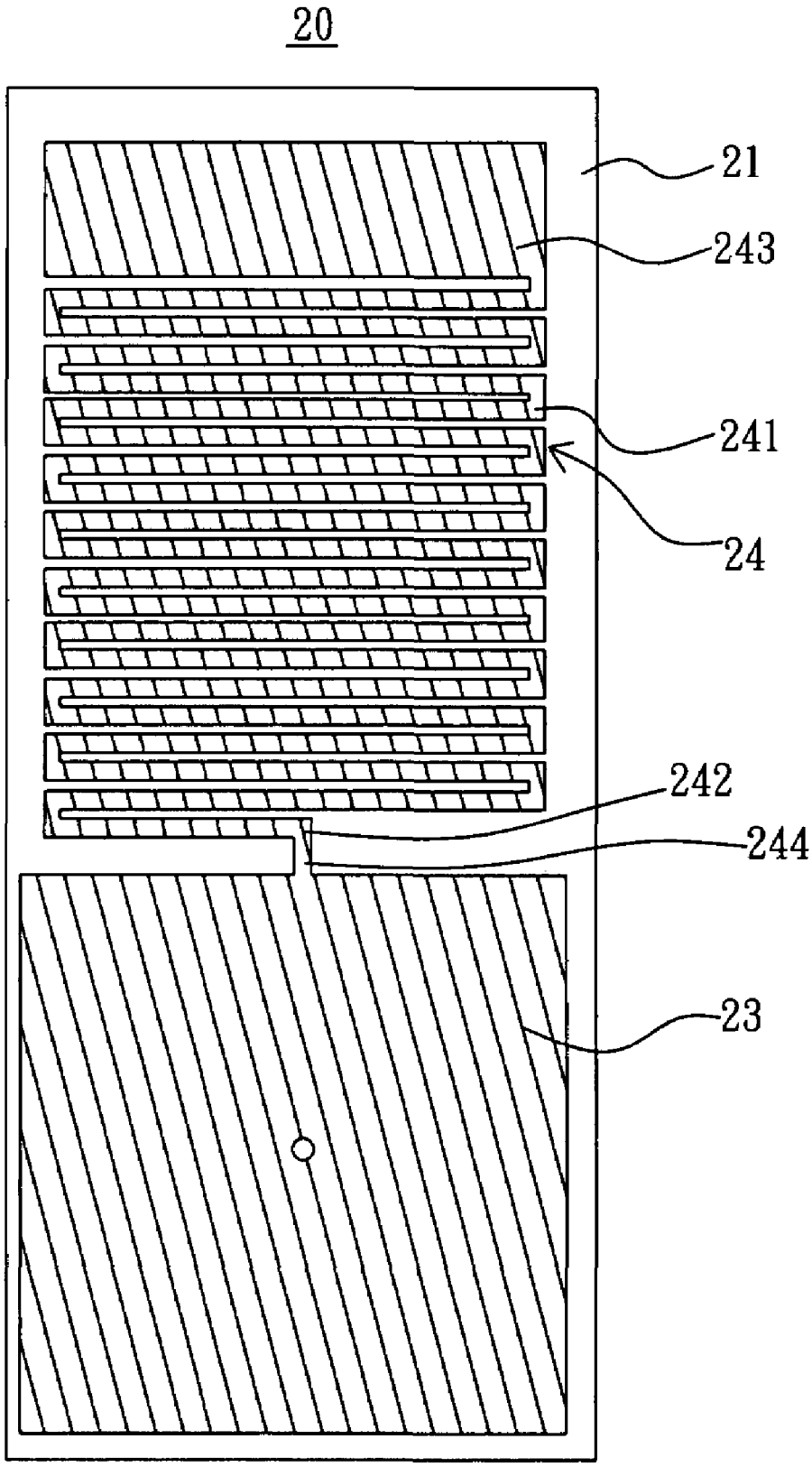
FIG. 3B is a schematic view, showing a second surface of an antenna of a first embodiment according to the present invention.

Please refer to FIGS. 2, 3A and 3B. A miniaturized planar antenna of digital television according to the present invention is used for being combined with a portable electronic device such as a cellular telephone, notebook computer and PDA so as to increase the efficiency of digital television signal transmission by means of the antenna. An antenna 20 of a first embodiment according to the present invention comprises an insulation plate 21, a metal radiator 22, a metal grounding element 23 and a metal parasitic element 24. The insulation plate 21 can be made from a general circuit board material.

The metal radiator 22 is used for allowing the antenna 20 to receive electromagnetic signals; the metal radiator 22 is combined with a first surface of the insulation plate 21; the radiator 22 includes a meander line portion 221, the meander line portion 221 has a first end 222 and second end 223; the first end 222 is connected to a micro-strip line 224, one end of the micro-strip line 224 is used as a feeding point 225 as FIG. 3A shows.

The metal grounding element 23 is used as a grounding terminal of the antenna 20; the metal grounding element 23 is combined with a second surface of the insulation plate 21 as FIG. 3B shows.

The metal parasitic element 24 is combined with the second surface of the insulation plate 21 and is corresponding to the position of the metal radiator 22. The metal parasitic element 24 includes a meander line portion 241 and a first end 242 of the meander line portion 241 is connected to a micro-strip line 244; another end of the micro-strip line 244 is connected to the metal grounding element 23. Besides, the meander line portion 241 has a second end 243 with a thicker line.

The main difference between the antenna 20 of the embodiment and the conventional antenna 10 is in that the antenna 20 of the present invention is not only combined with the metal grounding element 23 but also combined with a metal parasitic element 24 on the second surface of the insulation plate 21. Furthermore, the metal parasitic element 24 is corresponding to the metal radiator 22. The bandwidth of the antenna 20 can be broadly increased to allow the antenna 20 to elevate the signal transmission efficiency by means of the disposition of the metal parasitic element 24 according to the present invention.

Figure 4:
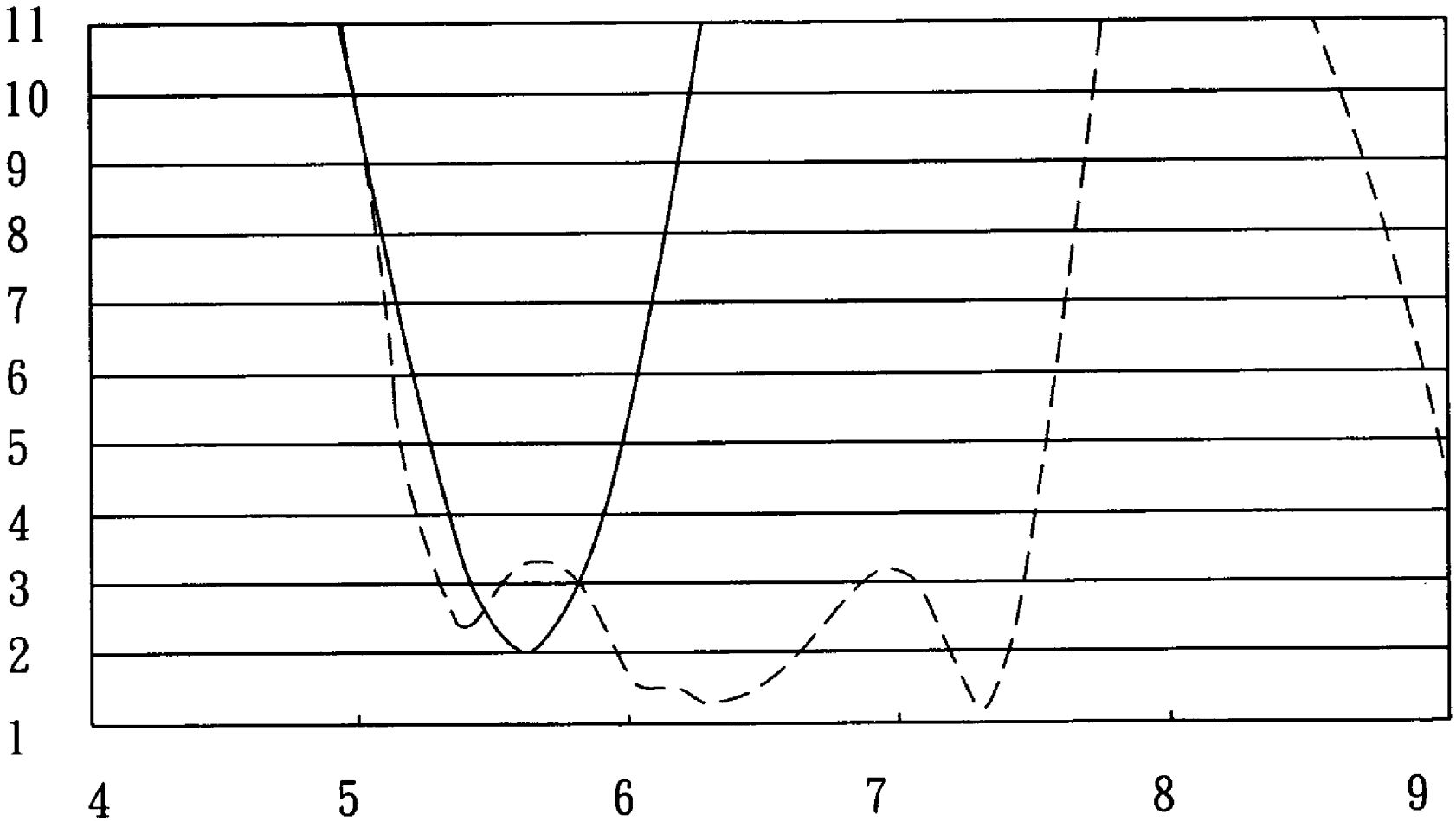
FIG. 4 is a voltage standing wave ratio measurement graph of an antenna according to the present invention and a conventional antenna.

A voltage standing wave ratio waveform graph as FIG. 4 shows is obtained after tests of an antenna with a metal parasitic element according to the present invention and a conventional antenna without a parasitic element. Dotted line and solid line portions respectively are the waveforms of the antenna according to the present invention and the antenna of the conventional antenna. The graph shows that the bandwidth of the antenna according to the present invention approximately is 250 MHz ($10^6$ Hz) and the bandwidth of the conventional antenna approximately is 50 MHz when the value of a voltage standing wave ratio (VSWR) is 4. This shows that the antenna according to the present invention has a broader bandwidth than the conventional antenna without the parasitic element. Therefore, not only the size of the antenna according to the present invention can be reduced but also the effect of increasing the bandwidth broadly can be attained such that the signal transmission efficiency of the antenna can be elevated.

Figure 5A:
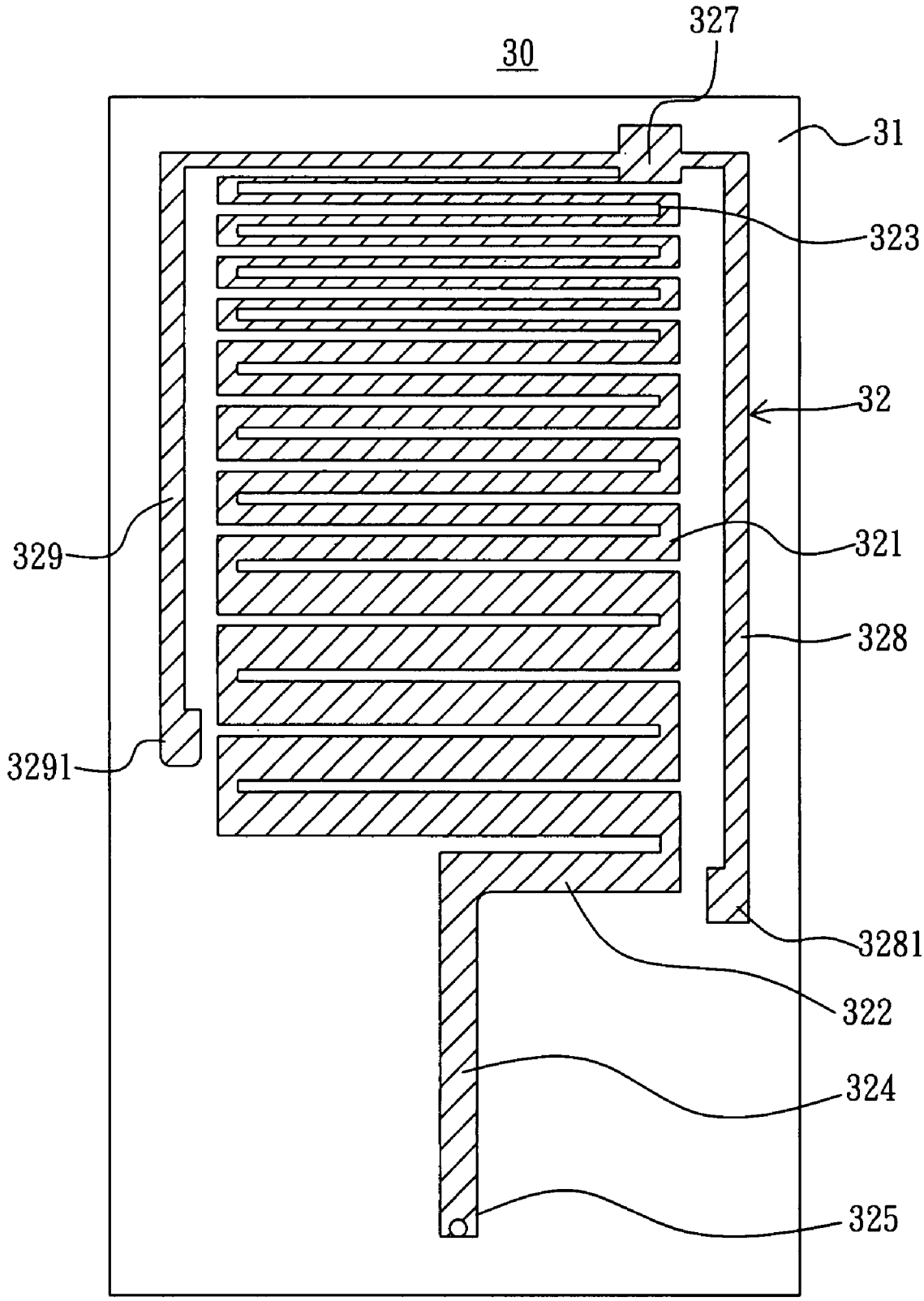
FIG. 5A is a schematic view, showing a first surface of an antenna of a second embodiment according to the present invention.
Figure 5B:
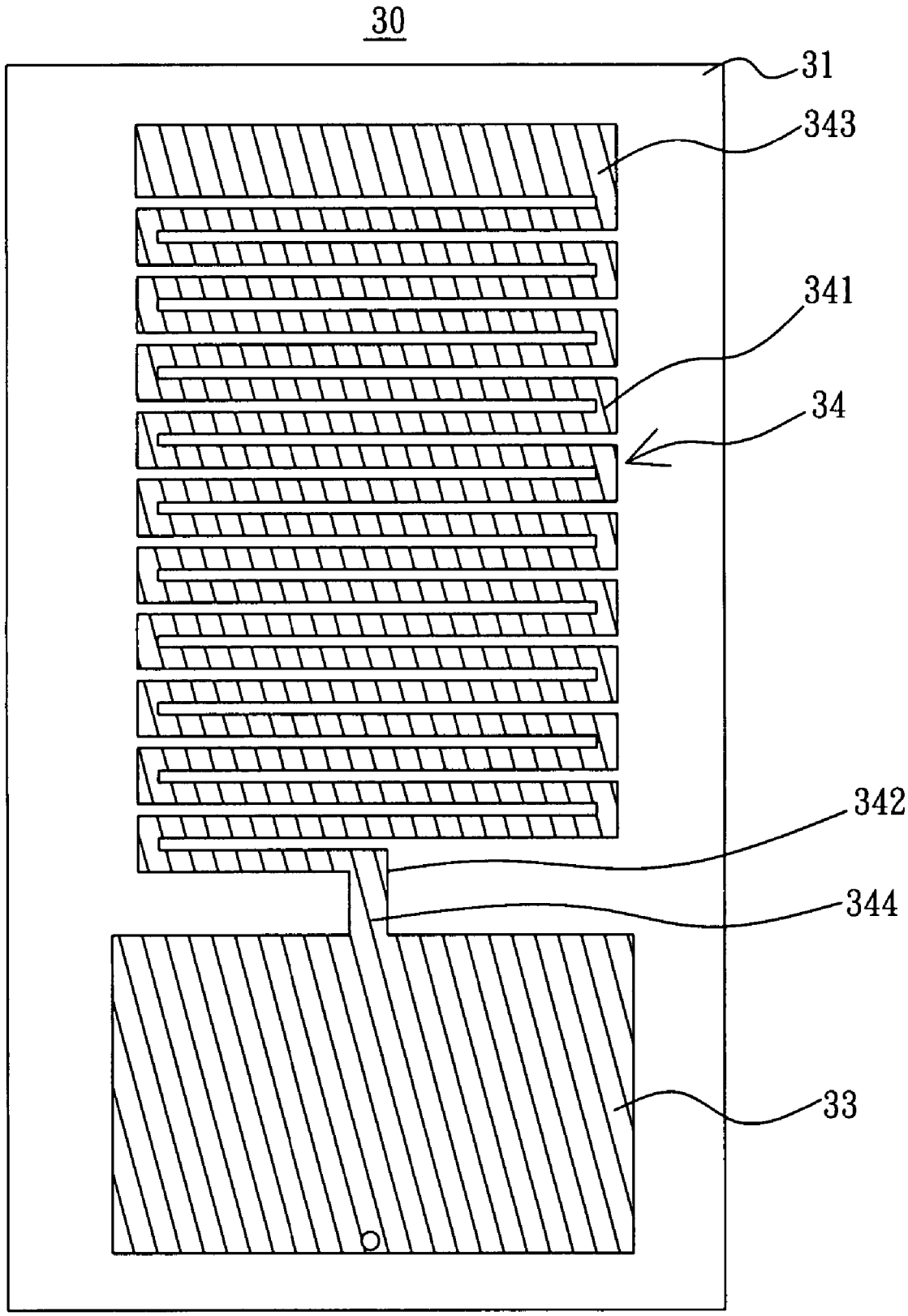
FIG. 5B is a schematic view, showing a second surface of an antenna of a second embodiment according to the present invention.
Figure 5C:
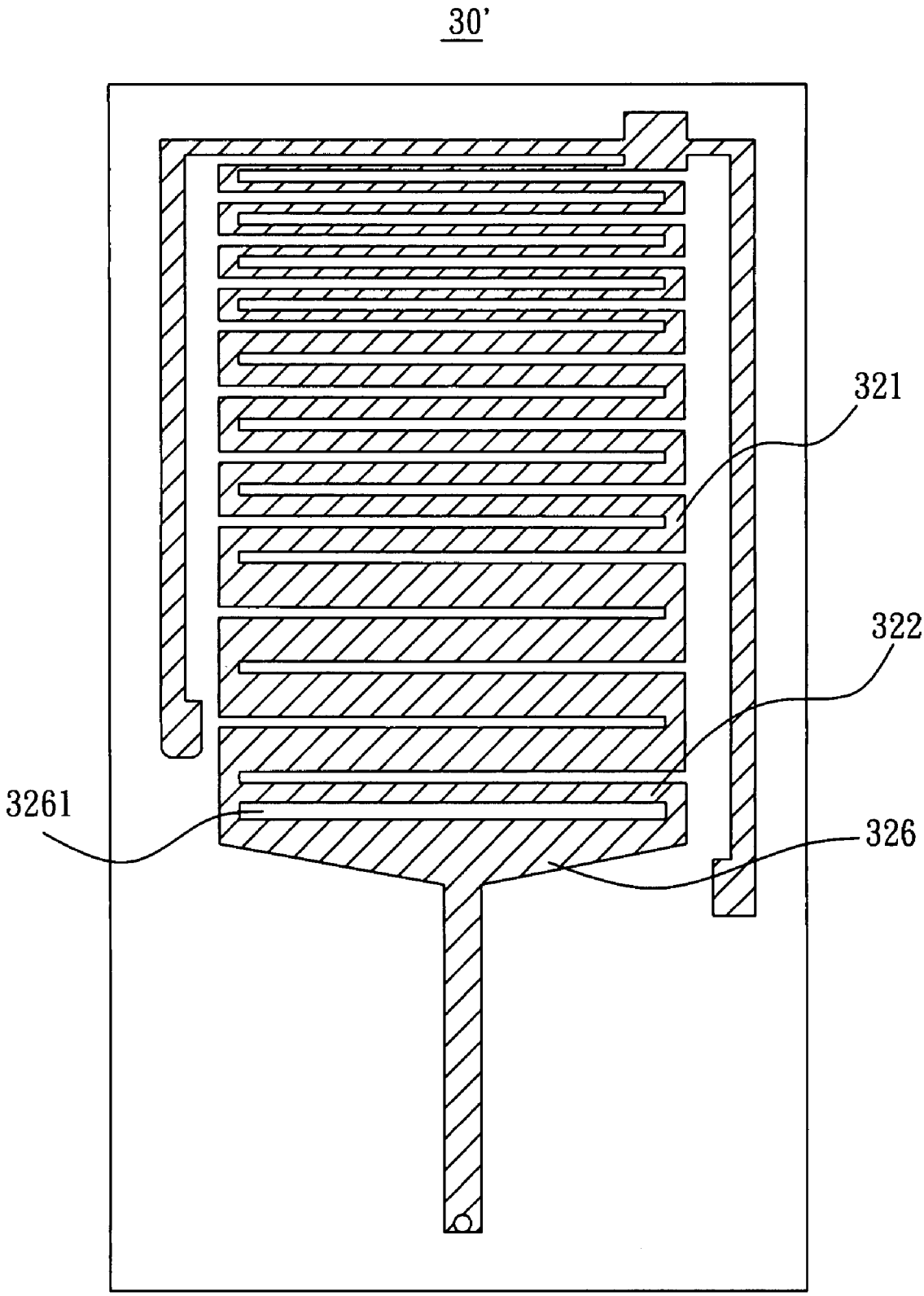
FIG. 5C is a schematic view, showing a first surface of an antenna of a third embodiment according to the present invention.

Please refer to FIGS. 5A, 5B and 5C. Each of miniaturized planar antennas 30 and 30' of a digital television according to the present invention comprises an insulation plate 31, a metal radiator 32, a metal grounding element 33 and a metal parasitic element 34. The insulation plate 31 can be made from a general circuit board material. The metal radiator 32 is used for allowing the antenna 30 to receive electromagnetic signals; the metal radiator 32 is combined with a first surface of the insulation plate 31 and includes a meander line portion 321, the meander line portion 321 has a first end 322 and second end 323; the first end 322 is connected to a micro-strip line 324, a end of the micro-strip line 324 is used as a feeding point 325. The second end 323 is connected to a metal load element 327 which is respectively connected with a first extending portion 328 and a second extending portion 329. The first extending portion 328 and the second extending portion 329 respectively have a load end portions 3281 and 3291 with a larger area as FIG. 5A shows. The metal grounding element 33 is used as a grounding terminal of the antenna 30; the metal grounding element 33 is combined with a second surface of the insulation plate 31 as FIG. 5B shows. The metal parasitic element 34 is combined with the second surface of the insulation plate 31 and is corresponding to the position of the metal radiator 32. The metal parasitic element 34 includes a meander line portion 341 and a first end 342 of the meander line portion 341 is connected to a micro-strip line 344; another end of the micro-strip line 344 is connected to the metal grounding element 33. Besides, the meander line portion 341 has a second end 343 with a thicker line as FIG. 5B shows.

Please refer to FIGS. 5A and 5C. The meander line portion 321 of metal radiator 32 is further allowed to have a shape that is gradually thickened from the second end 323 toward the first end 322; this also enables the bandwidths of both antennas 30 and 30' to be broadened. Furthermore, allowing the first end 322 of the meander line 321 to be connected to a triangular metal load element 326 and forming a groove 3261 on the triangular metal load element 326 also enable the bandwidth of the antenna 30' to be broadened as FIG. 5C shows. Allowing the second end 323 to be connected to a metal load element 327 also enables the bandwidth of the antenna 30 to be broadened. Allowing the second end 323 of the meander line portion 321 further to be connected to a first extending portion 328 and/or a second extending portion 329 or further allowing the first extending portion 328 or the second extending portion 329 respectively to have load end portion 3281 and 3291 with a larger area all enable the bandwidths of both antennas 30 and 30' to be broadened.

According to the present invention, the metal radiator, metal grounding element and metal parasitic element can respectively formed on the first and the second surfaces of the insulation plate by means of copper foil printing.

That an antenna with a metal parasitic element according to the present invention is further operated in coordination with each bandwidth broadening design disclosed in the second and the third embodiments mentioned above can even more attain to the bandwidth substantially broadening effect to enable the antenna to elevate the signal transmission efficiency.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A miniaturized planar digital television antenna, used for elevating the digital television signal transmission efficiency; said antenna comprising:

an insulation plate;

a metal radiator, allowing said antenna to receive electromagnetic signals, combined with a first surface of said insulation plate and including a meander line portion;

a metal grounding element, used as a grounding terminal of said antenna and combined with a second surface of said insulation plate; and a metal parasitic element, combined with said second surface of said insulation plate, corresponding to a position of said metal radiator and including a meander line portion wherein the meander line portion of said metal radiator has a first end and a second end, a first end of said meander line portion of said metal parasitic element being electrically connected to said metal grounding element, wherein an electromagnetic signal receiving bandwidth of said antenna is increased by means of said metal parasitic element.

2. The antenna according to claim 1, wherein said meander line portion of said metal parasitic element has a second end with a thicker line.

3. The antenna according to claim 2, wherein said first end of said meander line portion of said metal radiator is connected to a triangular metal load element with a larger area.

4. The antenna according to claim 3, wherein said meander line portion of said metal radiator is gradually thicker from said second end toward said first end.

5. The antenna according to claim 4, wherein said second end of said meander line portion of said metal radiator is connected to a metal load element with a larger area.

6. The antenna according to claim 5, wherein said metal load element is connected to a first extending portion.

7. The antenna according to claim 6, wherein said metal load element is further connected to a second extending portion.

8. The antenna according to claim 7, wherein said first extending portion and said second extending portion respectively having a load end portion with a larger area.

9. The antenna according to claim 8, wherein said first end of said metal radiator is connected to a micro-strip line via said triangular metal load element, one end of said micro-strip line is used as a feeding point; said first end of said meander line portion of said metal parasitic elements is connected to another micro-strip line; another end of said another micro-strip line is connected to said metal grounding element.

10. The antenna according to claim 9, wherein a groove is disposed on said triangular metal load element.

11. The antenna according to claim 1, wherein said first end of said meander line portion of said metal radiator is connected to a triangular metal load element with a larger area.

12. The antenna according to claim 11, wherein a groove is disposed on said triangular metal load element.

13. The antenna according to claim 1, wherein said meander line portion of said metal radiator is gradually thicker from said second end toward said first end.

14. The antenna according to claim 1, wherein said second end of said meander line portion of said metal radiator is connected a metal load element with a larger area.

15. The antenna according to claim 14, wherein said metal load element is connected to a first extending portion.

16. The antenna according to claim 15, wherein said metal load element is further connected to a second extending portion.

17. The antenna according to claim 16, wherein said first extending portion and said second extending portion respectively having a load end portion with a larger area.

18. The antenna according to claim 1, wherein said first end of said metal radiator is connected to a micro-strip line, an end of said micro-strip line is used as a feeding point; said first end of said meander line portion of said metal parasitic element is connected to another micro-strip line; another end of said another micro-strip line is connected to said metal grounding element.

19. The antenna according to claim 1, wherein said first and said second surfaces of said insulation plate are respectively formed with said metal radiator, said metal grounding element and said metal parasitic element by means of copper foil printing.

* * * * *